United States Patent [19]

Rumsey

[11] 3,935,794

[45] Feb. 3, 1976

[54] RADIAL PISTON PUMP/MOTORS

[76] Inventor: Rollin Douglas Rumsey, 148 Summer St., Buffalo, N.Y. 14222

[22] Filed: Jan. 20, 1971

[21] Appl. No.: 108,089

[52] U.S. Cl. ..... 91/488; 91/489

[51] Int. Cl.² ..... F01B 13/06

[58] Field of Search ..... 91/491–498; 417/273, 488, 489

[56] References Cited

UNITED STATES PATENTS

| | | | |
|---|---|---|---|
| 3,036,557 | 5/1962 | Kimsey | 91/498 |
| 3,199,460 | 8/1965 | Bush et al. | 91/487 |
| 3,225,701 | 12/1965 | Griffith | 91/488 |
| 3,311,030 | 3/1967 | Halstead | 92/167 |
| 3,650,180 | 3/1972 | Gantschnigg | 91/488 |
| 3,695,146 | 10/1973 | Orshansky | 91/488 |
| 3,777,624 | 12/1973 | Dixon | 91/488 |

FOREIGN PATENTS OR APPLICATIONS

| | | | |
|---|---|---|---|
| 357,979 | 9/1931 | United Kingdom | 91/496 |
| 884,556 | 6/1959 | United Kingdom | 417/213 |
| 1,025,722 | 3/1958 | Germany | 91/498 |

*Primary Examiner*—William L. Freeh

*Attorney, Agent, or Firm*—Hill, Gross, Simpson, Van Santen, Steadman, Chiara & Simpson

[57] ABSTRACT

Radial piston pump or motor has within its housing a stationary pintle valve, an external shaft connected to a rotating spider of which are mounted pressure balanced pivotal cylinders. Rigid piston - shoe assemblies engage the cylinders and ride on a cylindrical raceway the eccentricity of which is adjustable for stroke. Balanced annular sealing is provided between the pivotal cylinders and arcuately surfaced pockets therefor in the rotating spider/rotor.

13 Claims, 16 Drawing Figures

FIG. 3
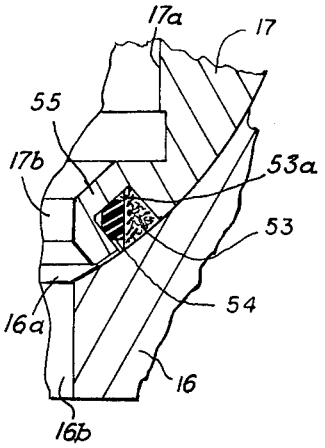
FIG. 4
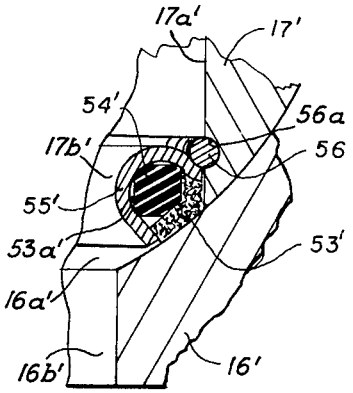
FIG. 5
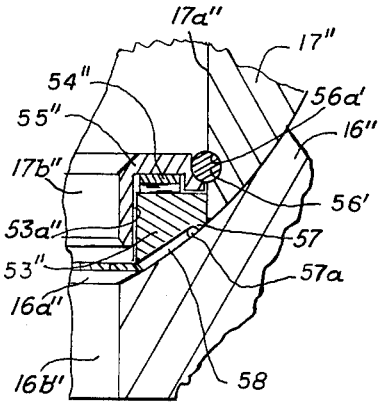
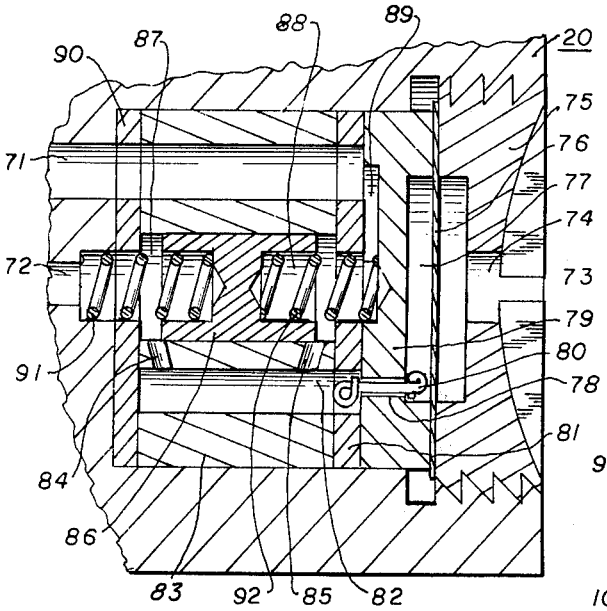
FIG. 6
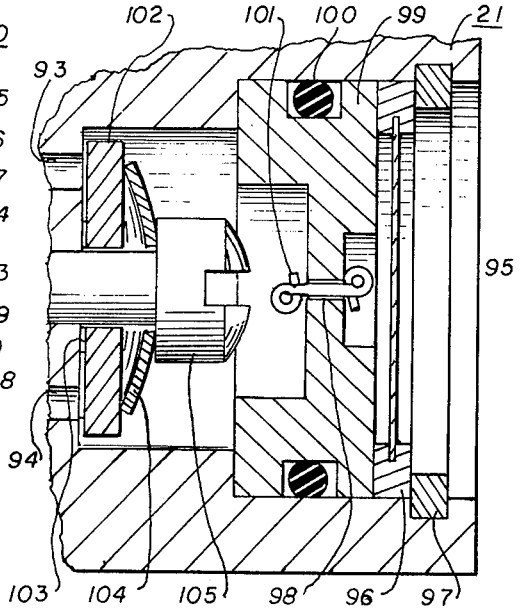
FIG. 7

FIG. 14
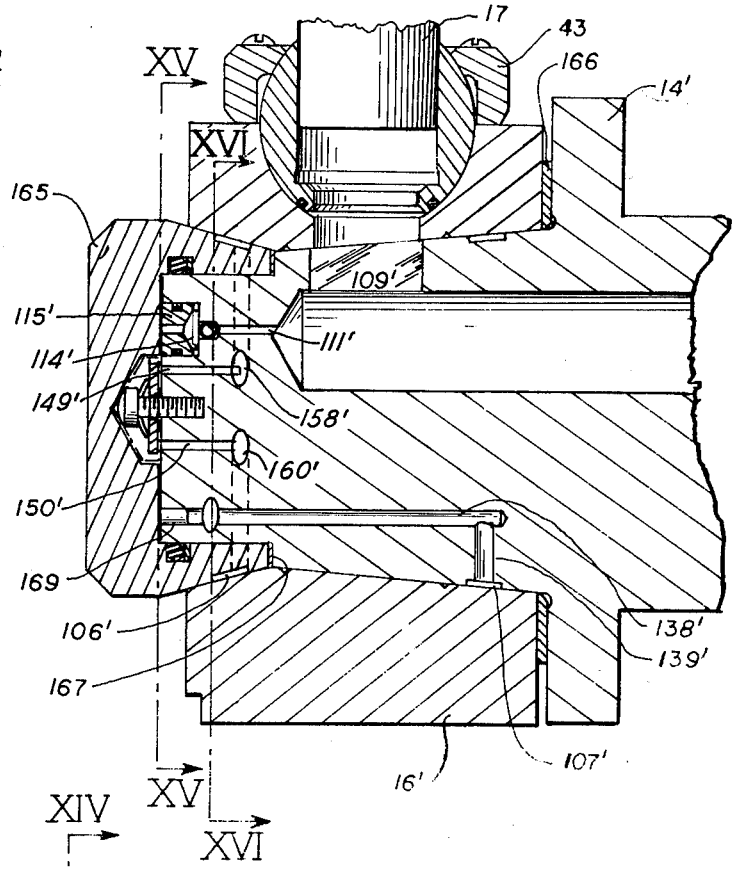
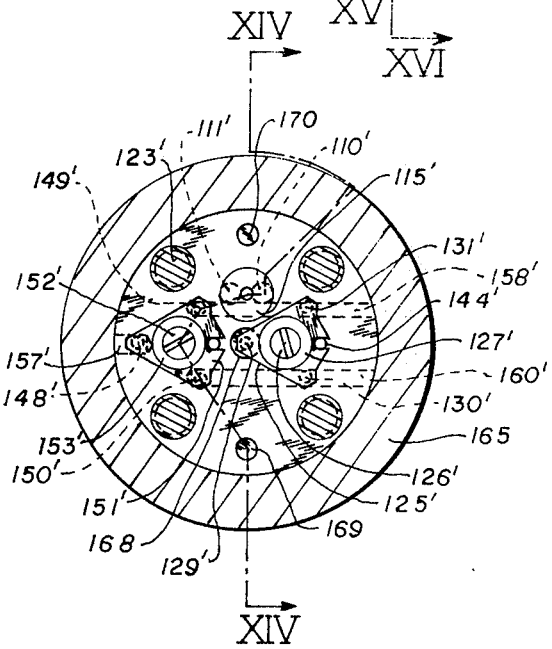
FIG. 15
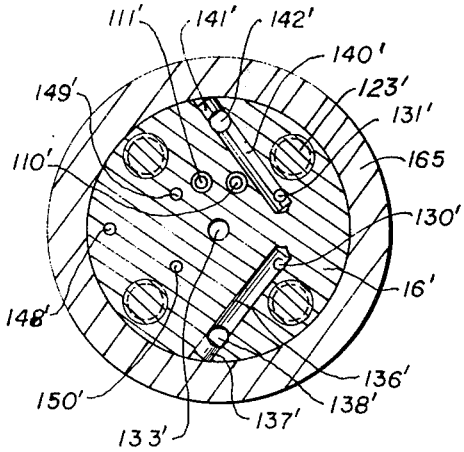
FIG. 16

RADIAL PISTON PUMP/MOTORS

This invention relates to radial piston fluid power devices and is particularly concerned with such structures having unusually high speed and efficiency capabilities.

There are many uses where it is desireable to operate hydraulic motors and pumps at higher speeds than is currently possible. For example, present hydraulic pumps are unable to operate without reduction gearing from diesel and gasoline engines, as a result the use of fluid power on mobile equipment is restricted largely to accessory drives.

It is accordingly an important object of this invention to provide a new and improved hydraulic pump/motor using a short stroke with reduced fluid flow losses and capable of running with a dry sump.

Another object of the invention is to provide complete hydraulic balance of all working parts thereby eliminating wear.

It is a further object of the invention to provide a simplified shuttle control valving system for centering the spider and reducing hydrastatic bearing flow rates and losses to a minimum.

Other objects, features and advantages of the present invention will be readily apparent from the following detailed description of certain preferred embodiments thereof taken in conjunction with the accompanying drawings in which:

FIG. 3 is an enlarged fragmentary sectional detail of substantially the area III of FIG. 1.

FIG. 4 is similar to FIG. 3 but showing a modification.

FIG. 5 is similar to FIG. 3 but showing another modification.

FIG. 6 is an enlarged fragmentary sectional detail view of modified fluid control means which may be used in the pump/motor pistons, and taken in substantially the same plane as FIG. 1.

FIG. 7 is an enlarged fragmentary sectional detail view of another modified fluid control means which may be used in the pump/motor pistons, taken in substantially the same plane as FIG. 1.

FIG. 14 is a fragmentary detail section substantially similar to FIG. 2 but illustrating a modification and taken along substantially the line XIV—XIV of FIG. 15.

FIG. 15 is an end elevational and sectional view taken substantially along the line XV — XV of FIG. 14.

FIG. 16 is a sectional view taken substantially along the line of XVI — XVI of FIG. 14.

Figure 1:
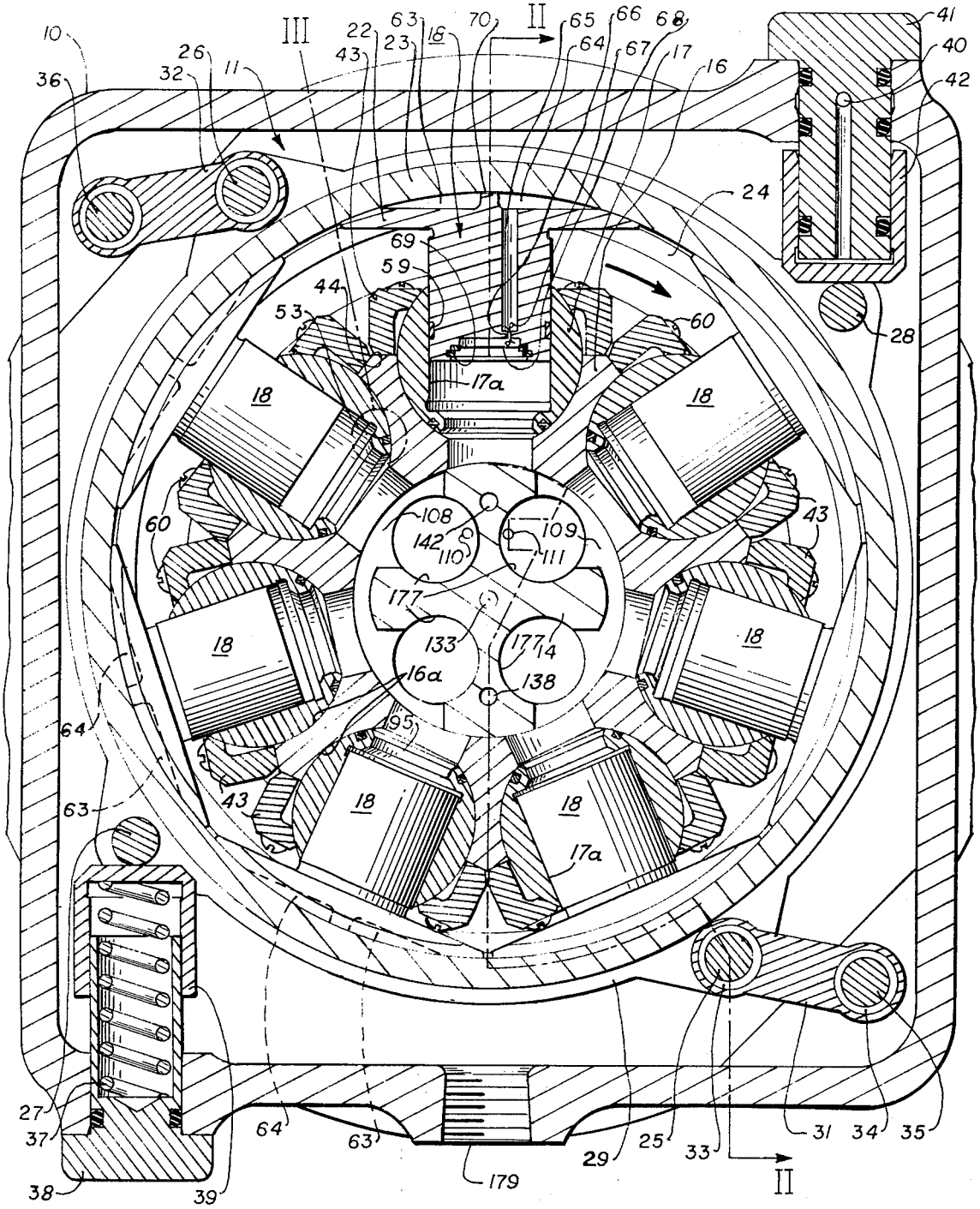
FIG. 1 is sectional elevational detail view through a pump/motor embodying features of the invention, and taken along substantially the line I—I of FIG. 2.
Figure 2:
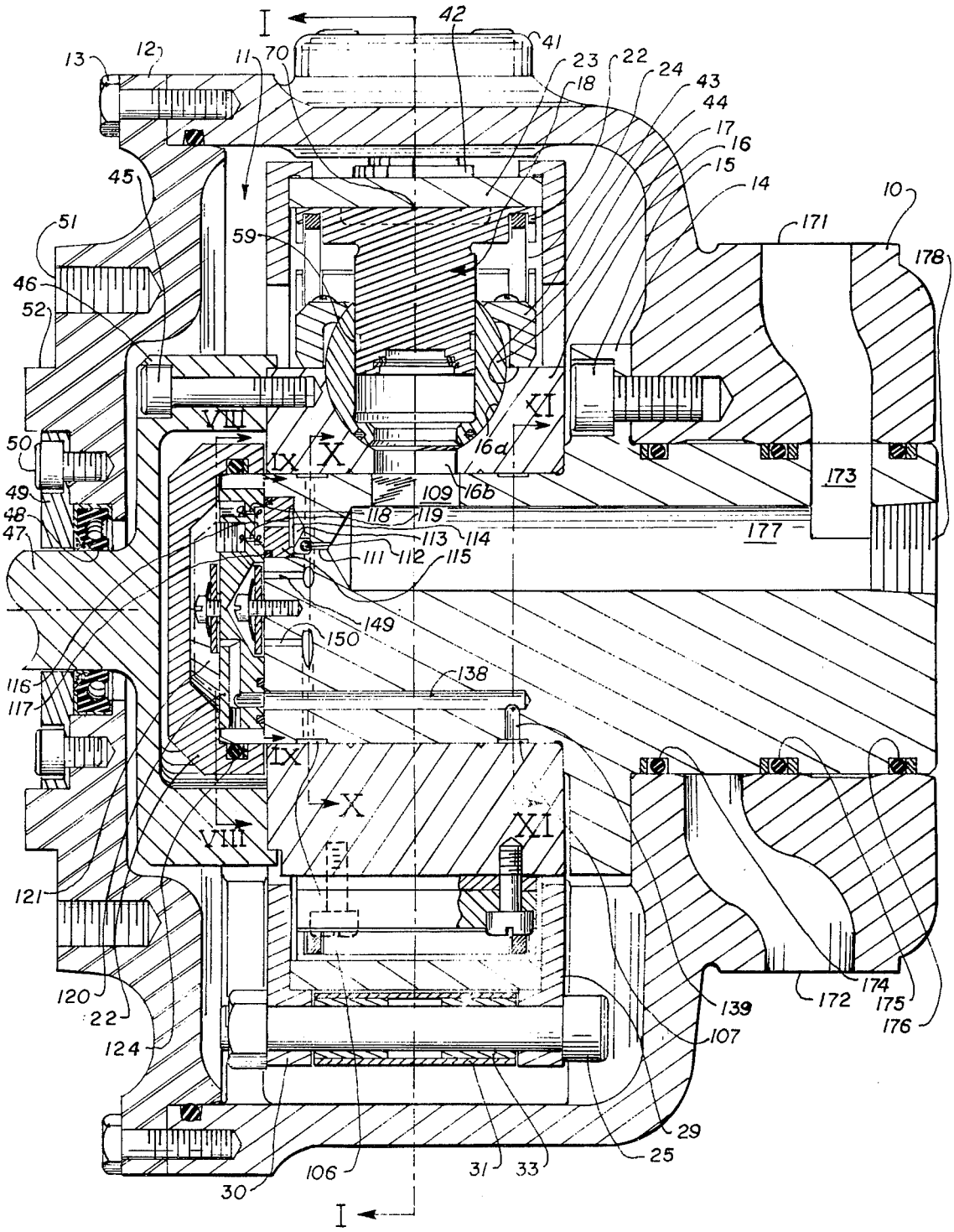
FIG. 2 is a longitudinal developed sectional detail view taken substantially along the line II—II of FIG. 1.

An hydraulic pump/moter embodying features of the invention and as exemplified in FIGS. 1 and 2 has a housing comprising a generally cup shaped body 10 of suitable size defining therein a chamber 11 closed at one end by an end closure member disk 12 held in place by bolts 13 and at the opposite end by a pintle valve plug member 14 attached to body member 10 by bolts 15. Surrounding and journalled in relatively rotary relation on the inwardly protruding stem of valve member 14 is a spider rotor member 16 equipped on its outer periphery with a number of arcuately surfaced, e.g. hemispherical, pockets 16*a* in which cylinder members 17 are received having bearing surfaces complementary to and riding in angularly slideable relation on the surfaces defining the pockets. Each cylinder member has a radially outwardly opening cylinder bore 17*a* and within which a piston 18, is reciprocably engaged. Each piston 18 carries a rectangular flanged end portion or slipper 22 the outer surface of which is arcuately complementally shaped to mate with the interior cylindrical raceway 23 against which they are gently held by hold down ring 24. Said raceway is clamped by bolts 25, 26, 27, 28, between stiffening flanges 29 and 30 which are pivotally mounted using a straight line motion 4-bar Watt's linkage consisting of links 31 and 32 jounalled on bearings 33 and 34 with bolts 25 and 26 and pins 35 and 36 mounted in housing 10.

In a pressure compensated pump version of the invention raceway 23 would normally be biased to maximum pumping stroke capacity by means of spring member 37 housed in plug cartridge 38 suitably secured in place as by means of screws (not shown), and acting against sleeve cap 39 and bolt 27, As pressure reaches the required level a control valve (not shown) normally will apply pressure from a suitable source to port 40 in piston cartridge 41 wherein it would act upon cylinder sleeve 42 to force it against bolt 28 and move piston raceway 23 toward a position of zero eccentricity or stroke thereby reducing pump delivery volume and pressure. In a servo version of the invention, spring cartridge 38 could be replaced with a piston cartridge similar to 41 wherein the control ports would be connected respectively to the output control ports of a servovalve by means of which the pumps eccentricity could be adjusted either side of zero thereby providing complete flow reversal.

Cylinder sleeves 17 are conveniently held in place by retainer members 43, clamped by screws 60 to rotor 16 and shimmed as necessary at interface 44 to provide free pivotal action with minimal looseness or clearance. Rotor 16 is connected by cap screws 45 to a flanged shaft member 46 by which power can be applied to or taken from the machine by shaft 47, which is sealingly engaged with the housing by seal means 48 clamped in place by seal retainer 49 held down by cap screws 50. Mounting of the pump/motor is provided by tapped mounting holes 51 and pilot diameter 52.

Means for effecting fluid communication between the valve means provided by the pintle 14 and the cylinder bores 17*a* and thereby with the radially inner ends of the pistons 18, include respective ports 17*b* at the radially inner ends of the cylinder members 17 concentrically aligned with the cylinder bores 17*a* and extending to and aligned with respective ports 16*b* in the rotor 16. The rotor ports 16*b* are of substantially smaller diameter than the cylinder bores 17*a* and communicate with the valve means provided by the pintle 14.

Sealing between the pivotal cylinder members 17 and the rotor 16 may be accomplished by means of respective annular seals 53 (FIGS. 1 and 3) mounted in assembly with the cylinder members in respective annular channel grooves 53*a* provided in respective annular solid portions 55 constricting the inner ends of the bores 17*a* and defining the respective ports 17*b*. Each of the grooves 53*a* and its seal 53 has an outside diameter substantially equal to the cylinder bore 17*a* in order to establish hydraulic balance. Such balance may be minutely adjusted by changing the seal groove and seal diameter to slightly more or less than the cylinder diameter, as required to match centrifugal force, to equalize wear patterns etc. In the enlarged view of the seal provided in FIG. 3 is shown a resilient ring member 54 constructed for example of an elastomer and used to preload the seal 53 from the mouth of the groove 53*a* toward the engaged pocket surface area surrounding the communication port 16*b*. In a preferred embodiment especially suitable for use in a relatively low speed version of the pump/motor, the seal 53 may comprise a ring constructed of glass-filled Teflon modified with small amounts of molybdenum-disulphide or cadmium.

An alternative cylinder sealing structure, as shown in FIG. 4, utilizes a through-bored cylinder member 17' having mounted in assembly therewith at the inner end of the bore 17*a'* a seal assembly including a separate seal retainer structure 55' which replaces the integral seal carrier 55 of FIG. 3. The retainer 55' is held in place within the inner end of the bore 17*a'* by a spring ring 56 seated in a retainer groove 56*a* in the inner end portion of the bore 17*a'* and locking the retainer 55' against radially inward movement from its seal mounting position at the inner end of the bore 17*a'*. The retainer 55' provides therewithin a channel groove 53*a'* which opens partially toward the adjacent inner end portion of the wall of the bore 17*a'* and largely toward the surface of the associated pocket 16*a*. Thereby a seal 53', which may be in the form of a seal ring of the same general character of material as the seal ring 53, carried within the mouth of the retainer 53' is preloaded toward the surface of the pocket 16*a'* and the adjacent portion of the wall of the bore 17*a'* by means of a resilient ring member 54' which may be of an elastomer material similarly as the pressure ring 54. In this instance the seal retaining ring member 55' provides a constriction at the inner end of the bore 17*a'* and defines the port 17*b'* at the inner end of the cylinder bore communicating with the rotor port 16*b'*.

Another alternative sealing arrangement, particularly desireable for high-speed operation, is depicted in FIG. 5. This includes a through-bored cylinder 17'', a separate annular channel-shaped seal retainer 55'' held in place within the inner end portion of the bore 17*a''* by means comprising a retainer of locking ring 56' seated in a suitable locking groove 56*a'* in the wall defining the inner end portion of the bore 17*a''* and providing a shoulder preventing radially outward movement of the retainer 55'' from its seal mounting position. In this instance the seal ring is provided by a split metallic piston type sealing ring 53'' which is preloaded to project from the channel groove 53*a''* toward the surface defined by the associated pocket 16*a''* by a wave spring 54''. It will be observed that the retainer 55'' defines the port 17*b''* at the inner end of the bore 17*a''* and communicating with the associated port 17*b''* in the rotor 16''. Inasmuch as metal seals exhibit excessive wear rates when subjected to unit loadings above approximately 500 psi it is desirable to reduce the fluid pressure loading of the seal to a minimum. This is effected herein by producing a pressure dam 57 along the low pressure side of the sealing face of the seal ring 53'' adjacent to convergence of the bore 17*a''* with the bearing surface of the pocket 16*a''*. The sealing surface provided by the dam 57 is separated from the remainder of the surface of the seal member 53'' engaging the surface of the pocket 16*a''* by an annular groove 57*a*, so that the major width of the sealing surface is toward the pressure side of the seal ring 53''. The groove 57*a* is connected to the inner or pressure side of the seal ring 53'' by means of notched passages 58. Thereby, pressure drop across the seal takes place across the narrow land 57 and the adjacent corner of the seal ring 53''. As a result, low seal loading is achieved resulting in minimal seal friction and easy swiveling, rocking of the cylinder 17''. Furthermore, although excellent balanced sealing is achieved, there is virtually no hydraulic force created under the seal ring 53'' to thrust the cylinder 17'' radially outwardly.

For maximum life and minimum wear it is desirable that mating relatively moving parts be constructed of different materials which in high pressure hydraulic machinery is often a difficult task because of the high strengths required on many of the members, extremely close clearances and problems of differential thermal expansion and the need to minimize scratching caused by entrained dirt or wear particles. The current invention overcomes most of the above problem areas when the pintle valve 14, cylinder sleeves 17, cylindrical raceway 23, and hold down rings 24 are constructed of heat treated steel and rotor 16 and pistons 18 are made from an alloy cast iron such as nodular or Meehanite. Piston seal ring 59, is used, may also be iron and cylinder seal ring 53'' may be chrome plated iron, steel, or beryllium copper.

The complete pumping force generated by the pistons 18 is reacted by their flange extension portion or shoe 22 into circular raceway 23 while sliding at high speed. Since the spherical portion of the cylinders sleeves produces a certain amount of resistance to pivoting action - even though hydraulicly balanced - due to friction at seal 53 and as a result of centrifugal force generated on the sleeves themselves against their hold down retainers 43 which contribute an additional small friction force, there results an uneven loading on the piston shoe 22. It is therefore extremely desireable that this uneven or cocking force does not cause one edge of the shoe to bind or drag.

An improved hydrostatic shoe design is shown on piston 18, FIGS. 1 and 2 wherein the hydrostatic pad is divided into two portions 63 and 64 respectively. The leading pad 64 is fed with fluid through passageway 65 from orifice 66 kept from clogging by floating wire 67 and screen 68 held in place by snap ring 69. Trailing pad 63 is fed from pad 64 through restrictive channel 70 in the form of a notch.

A further improved arrangement for supplying fluid to the hydrostatic shoes is illustrated in FIG. 6 where means for supplying the hydrostatic pads 64 and 63 with pressurized fluid comprises ducts 71 and 72 respectively which replace the single passage 65 depicted in FIG. 1. The fluid originates behind the piston at 73, through port 74 in clamping nut 75, progresses through screen 76 into chamber 77 where it is throttled by orifice 78 in plate 79, said orifice being equipped with anticlogging wire 80. Thence the fluid passes through soft metal gasket 81 into channel 82 in valve body 83 where it divides and enters pressure control valve ports 84 and 85 at which point it is selectively throttled by valve spool 86 which establishes substantially equal flows into chambers 87 and 88. The fluid in chamber 87 flows directly into channel 72 while the fluid in 88 flows back through gasket 81 through cross channel 89 into exit channel 71. A second soft metal gasket 90 seals channel 71 from 72. Springs 91 and 92 center valve spool 86.

It may be observed from the functioning of the flow balance valve of FIG. 6 that if one edge of the piston shoe tends to raise up, the valve spool immediately shuts off the flow to the hydrostatic pocket on that side, while diverting the total flow to the opposite side thereby developing a countertorque to overcome any cocking tendencies and at the same time conserving hydrostatic bearing fluid since but a single control orifice is required. Since the valve of FIG. 6 is not immune to the effects of centrifugal force, the porting is arranged such that as speed is increased the leading pocket 64 is favored, and given proportionately greater flow.

As mentioned above the valving of FIG. 6 suffers from the deficiency of speed sensitivity although in other respects is capable of satisfactory operation. It is the object of a still further improved valving arrangement shown in FIG. 7 to overcome the centrifugal effects of FIG. 6, reduce the complexity of parts, provide higher response rates and be more insensitive to dirt. Accordingly the hydrostatic pockets 64 and 63 of the piston are fed with pressurized fluid through ducts 93 and 94 respectively said fluid having again come from above the piston at 95, through screen member 96, held in place by spring ring 97, thence through orifice 98 in bulkhead 99 sealed by O-ring 100. A loose wire 101 may be employed to prevent clogging of orifice 98 as well as enabling a considerably larger drill size to be used since the net area should be approximately .00008 square inches for a 30 gallon per minute machine. The fluid next passes beneath valving disc 102 into the hydrostatic feed ports 93 and 94. Valve disc 102 rests on washer 103, approximately .002 inches thick, and is spring loaded thereagainst by cupped washer 104 and screw 105.

If the pressure in duct 93 is lower than 94 for example, the differential pressure acting on disc 102 will cock it thereby shutting off port 93 and increasing the opening available to port 94, hence the operation is similar to the valve of FIG. 6. For use in a clean system or where minimum cost is desired, orifice 98 and screen 96 may be omitted, however ports 93 and 94 should then be reduced in size.

In order to assure smooth running combined with minimum friction and leakage at the interface of pintle valve 14 and rotor 16 a pair of hydrostatic bearings 106 and 107 are employed. Operation of these bearings is relatively similar to the hydrostatic shoe control of FIG. 7. However in this instance a three way flow control or shuttle valve is employed for each bearing.

In operation of the pump/motor, relative rotation of the rotor 16 and the pintle valve member 14 progressively advances the rotor ports 16*b* past the pintle valve fluid transfer zones 108 and 109, best visualized in FIG. 2.

Referring to FIG. 1, the mode of operation of the bearing 106 and 107 follows: pressurized fluid is selected from the higher pressure of the two pintle valve zones 108 and 109 through passages 110 and 111 respectively each of which utilizes a ball check valve such as 112 FIG. 2 to permit flow into common chamber 113 and prevent backflow into the lower pressure zone. High pressure fluid then flows through screen 114 and through an opening in plug 115 to a second chamber 116 sealed by O ring 117 thence through parallel orifices 118 and 119 located in distributor plate 120.

Figure 10:
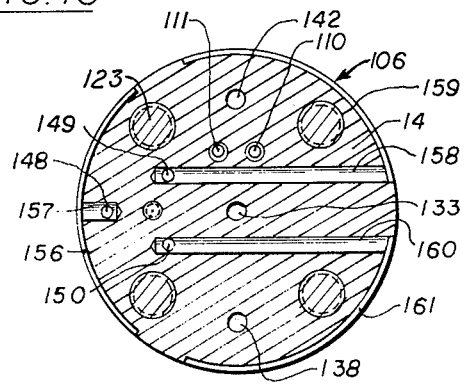
FIG. 10 is as a sectional view of the pintle taken substantially along line X — X of FIG. 2.
Figure 11:
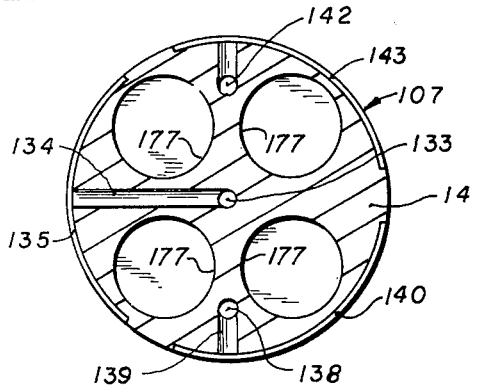
FIG. 11 is a sectional view of the pintle taken along line XI — XI of FIG. 2.
Figure 12:
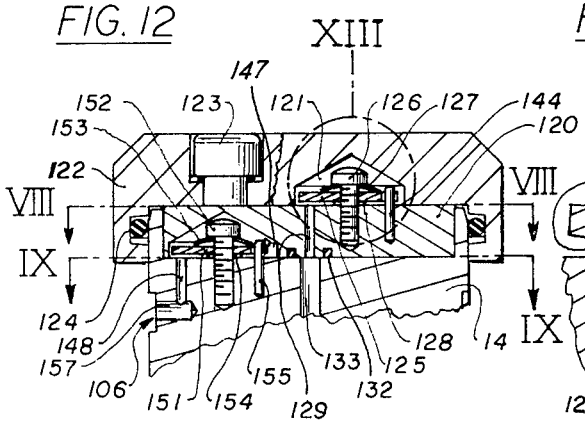
FIG. 12 is a horizontal sectional view taken substantially along line XII — XII of FIG. 8 and is essentially 90 degrees to the section of FIG. 2.

Orifice 118 supplies fluid to the chamber 121 above plate 120 formed by retainer cap 122 held down by cap screws such as 123 and sealed by O ring 124, FIG. 12. Said fluid is thus exposed to the area covered by triangular rocker 125 which is resiliently clamped by screw 126 and spring washer 127 against spacer washer 128 (approx. 0.002 inches thick) in a partial blocking position above ports 129, 130, and 131 - refer FIG. 8. Port 129 sealingly connects by O-ring 132 directly to drilled passage 133 which carries down the pintle centerline through sections shown in FIGS. 9 and 10 to FIG. 11 where it connects through cross port 134 to hydrostatic pocket 135 of bearing 107. Port 130 connects to cross hole 136 blocked at its end by plug 137 thence through drilled passage 138 to cross port 139 and to pocket 140 of bearing 107. Port 131 similarly connects to cross hole 140 also blocked by a plug 141 thence through passage 142 to pocket 143 of bearing 107.

Figure 13:
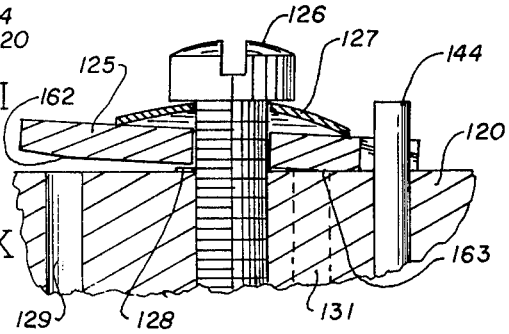
FIG. 13 is an enlarged sectional detail view of substantially the area XIII of FIG. 12.

If the rotor 16 is forced off center as for example by imperfect hydraulic balance such that the clearance at bearing area 107 is reduced on the side of pocket 135 and increased on the opposite side which is served by both pockets 140 and 143, the pressure in 135 will increase due to reduced leakage and the pressure in 140 and 143 will decrease because of increased leakage through the larger clearance. These pressure changes will result in a larger pressure drop between chamber 121 and ports 130 and 131 and a smaller drop between 121 and port 129 with the result that rocker disc 125 will tilt as shown in FIG. 13 in such a manner as to practically close ports 130 and 131 and open wide above port 129 thereby reducing the flow and pressure still more to pockets 140 and 143 and increasing both flow and pressure to pocket 135 which in turn will resist the unbalance force on the rotor and tend to restore it to center.

The action would be similar but in reverse if the clearance was wide at pocket 135 and close at both pockets 140 and 143, in which case the rocker would close off only port 129 and leave the others open relatively equal amounts. The same performance sequence can occur under any combination since the rocker 125 is triangularly symmetrical except for the slot which accomodates anti-rotation pin 144. It may further be noted that in a preferred embodiment the underside of rocker 125 should be slightly chamfered as at 162 and 163, FIG. 13, in order that more perfect flow blocking may occur.

Figure 8:
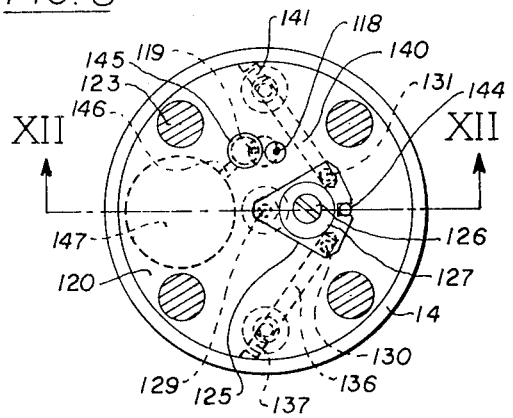
FIG. 8 is an end elevational and sectional view of the pintle valve taken substantially along line VIII — VIII of FIG. 2.
Figure 9:
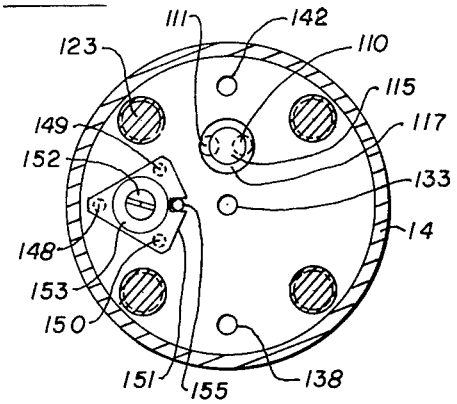
FIG. 9 is an end elevational and sectional view of the pintle taken substantially along line IX — IX of FIG. 2.

Operation of bearing 106 is similar to 107, however in this instance supply fluid passes through orifice 119 in plate 120 into a bore sealed by plug screw 145, FIG. 8, thence through cross hole 146 into valve chamber 147, FIG. 12, thence into ports 148, 149, or 150 as directed by valve rocker 151, FIG. 9, held by screw 152 and spring washer 153 against spacer washer 154 and prevented from turning by pin 155. Port 148 communicates with pocket 156 of bearing 106 by cross hole 157, FIG. 10, port 149 similarly through hole 158 to bearing pocket 159 and port 150 through hole 160 to pocket 161.

It may thus be realized that a considerable reduction in hydrostatic bearing fluid requirements are assured by the above described novel valving arrangement as well as providing the potential of greater centering force combined with minimum clogging, because only a single somewhat larger orifice is required per bearing in lieu of the normal practice of four orifices per bearing.

One of the difficulties encountered on hydraulic machinery utilizing pintle valves lies in the fact that the clearance between the rotor and pintle must be held to very close tolerances and if dirt enters this clearance scoring and/or rapid wear normally follows with the result that one part or the other must be replaced. Since both parts are usually relatively complex and expensive, the cost of maintenance repair is high compared to machines using face valving which frequently may simply be refaced and put back into service. It is an object of a further innovation in the present invention to overcome the above problem by the use of an hourglass pintle shown in FIG. 14 wherein the pintle member consists of two parts, stem 14' and cap member 165 each of which have conical exterior surfaces in the area occupied by the rotor 16' which is carried on hydrostatic bearings 106' and 107'. Since pintles are characteristicly quite weak and deflect appreciably, the use of a tapered section approximately doubles the strength hence the pressure capability of the machine.

Operation of the bearings 106' and 107' is basically similar to those for the cylindrical pintle 14 with the exception that the individual orfices 118 and 119 have been eliminated. It will be noted that these bearings are now capable of carrying thrust and that the initial running clearance is adjustable by selective fitting of spacer 166 and by shims 167. The function of spacer 166 is to assure that the rotor under conditions of shock for example cannot climb too far up the pintle taper and bind since the taper angle is a borderline locking taper as shown. The structure controlling bearing 106' is practically identical to 106 as may be noted by comparing FIGS. 2, 9, 10 and 12 with FIGS. 14 and 15. The structure controlling 107' differs slightly from 107 primarily as a result of the elimination of manifold plate 120 and is as follows: Fluid from pintle ports exemplified by 109' enters through passages 110' and 111' controlled by check valves, through screen 114', thence through the drilled center of plug 115' to the clearance area between the pintle 14' and its end cap 155. The fluid is now selectively allowed to flow into ports 129', 130' and 131' as regulated by pressure control valve rocker 125'. Port 129' is formed by a cored plug 168 inserted in the larger drilled passage 133', into which the fluid expands, thence proceeds to its appropriate pocket on bearing 107'. Metered fluid entering port 130' flows into cross port 136' closed by plug 137' at its outer end at which point the fluid flows into drilled passage 138' which is closed at its beginning by plug 169, said fluid again proceeding through 138' to its associated pocket in bearing 107'. The flow through port 131' is similar to 130', port 142' being blocked by plug 170 at the surface.

It will be understood that in the above described bearing control system that the major pressure drop, approximately 50 percent or more of the pressure available will occur at the junction of the valve rocker member and its associated ports and that the total flow to each hydrostatic bearing will be approximately equal in spite of the fact that the taper angles, hence projected areas of the bearings differ by approximately the ratio of three to one. The reason for this seeming paradox is the fact that the rotor to pintle valving interface is on the pintle member and its projected area also develops a thrust force in opposition to bearing 106' - hence bearing 106' must produce a thrust equal to 107' plus the valving interface area to maintain floating balance.

Fluid flow ports 171 and 172 in housing 10, FIG. 2, connect the machine to its external circuit. Said ports connect to the pintle valve 14 by means of milled slots such as 173 which are sealed from one another by seals 174, 175 and 176. Fluid flows into the pumping section through longitudinal drilled passages 177 in the pintle each sealed by a plug 178 there being two of the passages 177 in communication with the fluid transfer valve zone 108 and two of the passages 177 in communication with the fluid transfer valve zone 109. Any fluid leakage into the housing cavity 11 may be piped off through case drain port 179 to the external system reservoir, (FIG. 1).

It will be understood that modifications and variations may be effected without departing from the scope of the novel concepts of the present invention.

I claim:

1. In a radial piston pump/motor structure including a housing providing a chamber with a shaft extending therefrom in relative rotary relation:

valve means carried by the housing within said chamber;

a rotor journaled within said chamber and operationally attached to the shaft;

arcuately surfaced pockets in the outer perimeter of said rotor;

cylinder members in said pockets having bearing surfaces complementary to and riding in angularly slideable relation on the pocket surfaces;

means secured to the rotor maintaining the cylinder members in the pockets;

each of said cylinder members having a radially outwardly opening cylinder bore within which is radially reciprocably mounted a piston projecting radially outwardly and having on its radially outer end a shoe riding a surface within said enclosure facing toward said rotor;

means for effecting fluid communication between radially inner ends of said cylinder bores and said valve means and thereby with the radially inner ends of said pistons, and including respective ports at the radially inner ends of said cylinder members concentrically aligned with said cylinder bores and extending to and aligned with respective ports in said rotor and which rotor ports are of substantially smaller diameter than said cylinder bores and communicate with said valve means;

each of said cylinder members having an annular constriction providing the respective port at its radially inner end, said constriction providing seal retaining means; and annular sealing means retained by said seal retaining means in assembly with said cylinder members in surrounding relation to said cylinder member ports and:

said sealing means being in fluid sealing engagement with the surface areas of said pockets surrounding said rotor ports;

said sealing means being of substantially the same diameter as the diameter of said cylinder bores and maintaining a balanced sealing relationship between the cylinder members and said surface areas in all relative angular positions of the cylinder members and said surface areas.

2. A structure according to claim 1, wherein each of the cylinder members has the annular constriction integral therewith at the radially inner end of its cylinder bore, said constriction having a sealing ring groove opening toward the adjacent pocket surface and having said sealing means in the form of a sealing ring mounted in the groove and normally biased toward sealing engagement with said pocket surface.

3. A structure according to claim 1, wherein said radially inner end port of each of the cylinder members is of substantially the same diameter as the associated rotor port.

4. A structure according to claim 1, wherein said cylinder bores extend throughout the bearing surfaces of the cylinder members, and said constrictions and sealing means comprise ring assemblies attached to the cylinder members within the radially inner ends of the cylinder bores adjacent to the bearing surfaces of the cylinder members.

5. A structure according to claim 4, wherein said ring assemblies comprise respective annular generally channel-shaped ring members having channels opening toward the respective pocket surfaces, said sealing means comprising sealing rings mounted in said channels, and loading means within said channels biasing the sealing rings toward and into sealing engagement with the pocket surfaces.

6. A structure according to claim 5, wherein the cylinder members have annular locking grooves in the inner end portions of the cylinder bores, and retaining rings seated in said cylinder bore grooves and retaining said ring members against displacement radially outwardly in the cylinder bores.

7. A structure according to claim 5, wherein said channels open also toward the radially innermost portions of the cylinder bores, and said loading means bias the sealing rings against said innermost portions as well as against the pocket surfaces.

8. A structure according to claim 5, wherein said sealing rings are metal and said loading means comprise wave springs.

9. A structure according to claim 8, wherein said metal sealing rings have sealing surfaces of substantial width engaging the pocket surfaces, and means in said sealing surfaces for minimizing fluid pressure loading of the sealing rings either toward the pocket surfaces or radially outwardly relative to the cylinder members.

10. A structure according to claim 9, wherein said pressure relieving means comprise an annular relief groove in each of the sealing surfaces adjacent to the side of the sealing ring which is nearest the cylinder bore, and passages leading from the inner side of the sealing ring to the relief groove, there being a sealing dam area of said sealing surface between the relief groove and the side of the seal which is nearest the cylinder bore.

11. In a radial piston pump/motor structure including a housing providing a chamber with a shaft extending therefrom in relative rotary relation:

a pintle valve member concentrically aligned with said shaft in fixed relation to the housing within said chamber;

a rotor within said chamber corotatively attached to the shaft and journaled on said pintle valve member in concentric relative rotary relation;

hemispherical pockets is the outer perimeter of said rotor;

spherical cylinder member complementary to and riding swivelly slideably in said pockets and retained therein by means secured to the rotor;

each of said cylinder members having a radially outwardly opening cylinder bore within which is radially reciprocably mounted a piston projecting radially outwardly and having on its radially outer end a shoe riding a cylindrical raceway within said enclosure, the raceway having means for controlling it between concentric and eccentric positions relative to said rotor;

means for effecting fluid communication between radially inner ends of said cylinder bores and said pintle valve member and thereby with the radially inner ends of said pistons, and including respective ports at the radially inner ends of said cylinder members conecntrically aligned with said cylinder bores and extending to and aligned with respective ports in said rotor, and which rotor ports are of substantially smaller diameter than said cylinder bores and communicate with said pintle valve member;

each of said cylinder members having an annular constriction providing the respective port at its radially inner end, said constriction providing seal retaining means;

annular sealing means retained by said seal retaining means in assembly with said cylinder members and surrounding said cylinder member ports, said sealing means being in fluid sealing engagement with annular surface areas of said pockets surrounding said rotor ports; and said sealing means being substantially equal in diameter to said cylinder bores and maintaining with said pockets a balanced sealing relationship between the cylinder members and the rotor.

12. A structure according to claim 11, wherein each of the cylinder members has the annular constriction integral therewih at the radially inner end of its cylinder bore, said constriction having a sealing ring groove opening toward the adjacent pocket surface and having said sealing means in the form of a sealing ring mounted in the groove and normally biased toward sealing engagement with said pocket surface.

13. A structure according to claim 11, wherein said cylinder bores extend throughout to the bearing surfaces of the cylinder members, and each of said constrictions and sealing means comprises a ring assembly attached to the respective cylinder members within the radially inner ends of the cylinder bores adjacent to the bearing surfaces of the cylinder members.

* * * * *